US005243325A

United States Patent [19]

Marin et al.

[11] Patent Number: 5,243,325

[45] Date of Patent: Sep. 7, 1993

[54] LATCH GATE ALARM SWITCH ASSEMBLY

[76] Inventors: Ricardo E. Marin; Marta C. Marin, both of 1525 Placentia, No. G4, Newport Beach, Calif. 92663

[21] Appl. No.: 811,642

[22] Filed: Dec. 23, 1991

[51] Int. Cl.[5] ..... G08B 13/08; H01H 3/02; E05C 3/06

[52] U.S. Cl. ..... 340/545; 200/61.93; 292/235

[58] Field of Search ..... 340/545, 541-542, 340/550, 573; 200/61.83, 61.93, 61.62, 61.41, 244, 553, 557, 560, 337, 339; 292/235; 70/DIG. 49, 432; 49/13

[56] References Cited

U.S. PATENT DOCUMENTS

| | | | |
|---|---|---|---|
| 997,036 | 7/1911 | Blackburn | 340/545 X |
| 3,266,831 | 8/1966 | Banse | 292/235 X |
| 3,433,518 | 3/1969 | Foltz | 292/235 X |
| 3,569,642 | 3/1971 | Grover | 200/61.13 |
| 4,465,997 | 8/1984 | Hines | 340/542 |

*Primary Examiner*—Thomas Mullen
*Attorney, Agent, or Firm*—Leonard Tachner

[57] ABSTRACT

A switch assembly having a frame bracket with screw holes designed to permit easy and convenient attachment to the frame of a latch gate. The bracket is designed to support a switch arm, a portion of which engages the latch bar mounted on the door or gate of the latch gate. The switch arm includes a contact which is in electrical communication with a switch pole whenever the latch gate is not fully closed and secured. However, when the latch is fully secured, the switch assembly of the present invention is designed to permit the latch bar to engage the switch arm to interrupt electrical communication between the switch arm contact and the switch pole. Thus, the present invention is designed to provide a normally closed switch whenever a latch gate is not fully secured in its locked position for energizing an alarm circuit and to de-energize such an alarm circuit only when the latch gate is in its fully secured and locked position.

8 Claims, 3 Drawing Sheets

LATCH GATE ALARM SWITCH ASSEMBLY

BACKGROUND OF THE INVENTION

1. Field of the Invention

The present invention relates generally to the field of security systems and more specifically to a gate alarm switch which is primarily configured for mechanical and electrical compatability with latch gates and the like of the type which use a latch bar, a catch and a cam retainer, the alarm switch of the present invention being configured to provide preferably an audible signal whenever the latch gate is not fully secure in a closed and locked position. The invention hereof is especially suitable for swimming pool-access gates to prevent or at least advise of an inadvertently opened latch gate which is otherwise intended to prevent a unauthorized entry by small children into a pool area.

1. Prior Art

The hazard and potentially catastrophic risk of a swimming pool to small children is unfortunately well known. The number of accidental drownings of small children in residential swimming pools is far too high. Even one such tragic incident in any community each summer is a disaster for the entire community. Accidental drownings of young children are not only a catastrophe for the families touched by such accidents, but they also constitute a significant and potentially costly risk of liability for the owner of the swimming pool. The remedy of course is to completely enclose the swimming pool with a fence which cannot be breached by small children. However, even such a fence must provide a convenient access to the swimming pool users, normally in the form of a latched gate or door built into the fence. The latch assemblies normally used on such latched gates are of the type which employ a latch bar and a catch operating in conjunction with a cam retainer and located high enough to prevent small children from gaining access to manually open such latch assemblies. However, in order for such latch assemblies to be effective to prevent the inadvertent access to small children to swimming pools and other dangers enclosed by fences, it is necessary, indeed it is critical, that such latch assemblies be securely closed in their locked position so that the gate or door cannot be opened without first manually releasing the cam retainer, allowing the latch bar to be removed from the catch upon opening of the door or gate. Without a securely closed latch assembly, even the smallest toddlers attracted to a swimming pool or other potential hazard, can readily open such a gate without the knowledge of any nearby adult, and thus lead to a tragic result.

There have been attempts to commercialize devices designed to prevent such tragedies. By way of example, one manufacturer offers a motion alert system wherein a transmitter is mounted on the gate and generates a radio frequency signal to a remotely positioned receiver in response to motion of the gate. Unfortunately, such sophisticated systems tend to be expensive, a significant factor for discouraging their use. In addition, a motion detector device only operates to alert the homeowner of a door being opened when it is in motion and thus in the process of actually being opened. If no one is within hearing distance of the alarm when a child actually opens such a door or gate, such an alarm system is useless for the purpose herein above described. A much more effective alarm system for use with latch gates normally employed to provide access to enclosed pool areas and the like would be an alarm system which alerts nearby adults each time a latch gate is not firmly secured in its locked position. Such a device would be especially effective for latch assemblies of the type using cam retainers because such cam retainers do not always function properly, even when a visual inspection of the latch gate from any but the closest distances would fail to reveal that the latch assembly is not fully secured. The prior art is replete with a variety of different manually operated switches which are or can be designed, to interface electrically with an alarm system However, none of such prior art switch devices known to the applicant herein, is specifically designed for use in a latch gate configuration for assuring with a high degree of certainty that a latch assembly employed therein is securely closed.

The prior art known to the applicant includes the following U.S. Pat. Nos.

3,266,029 Callahan
4,194,193 McDonough
4,284,980 Hoinski
4,284,982 Downey
4,376,276 Barta
4,686,504 German
4,688,023 McGill et al
4,691,195 Sigelman et al
4,721,946 Zunkel
4,808,974 Cantley
4,843,374 Sansky
4,912,456 Mickel U.S. Pat. No. 4,688,023 to McGill is directed to a container having a child safety device and alarm. The alarm has a case or housing with transducer, a slide switch for enabling, an internal battery, and an alarm lever arm that operates an internal switch for sounding the alarm. The alarm system is disposed so that the lever arm is held by the device cover, latch or the like.

U.S. Pat. No. 4,376,276 to Barta is directed to a door alarm with flexible switch actuator. The self-contained alarm has a housing, cover, horn, battery, and operating switch with an arm that extends outside the housing with a resilient extension. The housing mounted to a stationary object is positioned so that the arm is engaged by the door when it is opened.

U.S. Pat. No. 4,808,974 to Cantley is directed to a self-contained portable door alarm. The alarm for mounting on a door with frame has a housing with an audible alarm, a mounting bracket, internal battery, and a set switch. Projecting from the top of the housing is alarm actuating lever biased to turn the alarm on. When properly mounted on the door, the frame holds the actuating lever against its bias, thus keeping the alarm off. A lock-on circuit can be provided to maintain the alarm on the position once activated.

U.S Pat. No. 3,266,029 to Callahan is directed to a self-container burglar alarm system. The system has a casing which encloses a horn, batteries, and a motor drive system for a time delay. A control arm assembly projects outside the casing with an arm for engaging the door frame and maintaining the horn in the off condition. When the door is opened, a biasing spring moves the arm so that a contact energizes the horn after an appropriate time delay from the motor cam circuitry.

U.S. Pat. No. 4,912,456 to Mickel is directed to a door latch alarm. The door latch alarm has a housing mounted on the inside and outside of the door supporting door handle. The upper compartment of the housing contains a battery, bell, deactivate switch, and contact fingers. The latch bolt has a link supporting the contact that engages the contact fingers when the latch is moved rearward by operating the handle.

There is therefore a long felt and unresolved need for a relatively low cost and relatively simple, but yet relatively fool-activated system for assuring secure closure of a latch gate of the type described hereinafter.

SUMMARY OF THE INVENTION

The switch assembly and alarm system of the present invention is designed to satisfy the aforementioned unresolved long felt need by providing a relatively low cost system for use with latch gates to provide a switch closure for activating an alarm whenever such a latch gate is not fully and firmly secured in a locked position. The principal intention of the present invention is to provide an audible alarm whenever a latch gate is not fully secured, in order to prevent inadvertent access to a hazardous area, such as a swimming pool area, to young children who are incapable of unlatching such gates, but are indeed all too often capable of opening such gates when the latches thereof are not fully secured. The present invention is designed to energize an alarm whenever the gate is even slightly open and to terminate such an alarm only when the gate is fully secured in its locked position, requiring manual operation of a cam retainer to unlock it.

The invention in its preferred embodiment herein disclosed comprises a switch assembly having a frame bracket with screw holes designed to permit easy and convenient attachment to the frame of a latch gate. The bracket is designed to support a switch arm, a portion of which engages the latch bar mounted on the door or gate of the latch gate. The switch arm includes a contact which is in electrical communication with a switch pole whenever the latch gate is not fully closed and secured. However, when the latch is fully secured, the switch assembly of the present invention is designed to permit the latch bar to engage the switch arm to interrupt electrical communication between the switch arm contact and the switch pole. Thus, the present invention is designed to provide a normally closed switch whenever a latch gate is not fully secured in its locked position for energizing an alarm circuit and to de-energize such an alarm circuit only when the latch gate is in its fully secured and locked position to deny access by small children to a hazardous, enclosed attraction such as a swimming pool or the like. Thus, use of the present invention will assure that a latch gate is properly closed because only then will an audible alarm be terminated. A unique feature of the present invention is that it is structurally configured to be added to existing latch gates with a minimum amount of manual labor required to provide such an installation. Furthermore, it is designed to be compatible with all such cam retainer type latch gates, without interfering with the normal operation thereof and it is a simple and inexpensive structure which makes it more likely to be readily adopted and used as a community standard for preventing the tragic drowning of young children and other related injuries.

OBJECTS OF THE INVENTION

It is therefore a principal object of the present invention to provide a novel switch assembly designed for installation with existing latch gates to permit energizing an electrical alarm to provide an audible signal whenever such a latch gate is not fully locked, to thus prevent inadvertent opening of such gates, such as by young children attracted to dangerous areas.

It is an additional object of the present invention to provide a novel switch assembly for use with latch gates and which may be readily installed in existing latch gates and having therein a mechanically activated switch responsive to the position of the latch bar of a conventional cam retainer type latch assembly to minimize or entirely obviate inadvertently unsecured latch gates which might otherwise pose a hazard, such as by allowing small children to enter dangerous areas such as swimming pool areas and the like.

It is still an additional object of the present invention to provide a low cost, easily installed switch assembly and alarm device for generating a constantly heard alarm whenever a latch gate to an enclosed area is inadvertently left unsecured.

BRIEF DESCRIPTION OF THE DRAWINGS

The aforementioned objects and advantages of the present invention, as well as additional objects and advantages thereof will be more fully understood hereinafter as a result of a detailed description of a preferred embodiment when taken in conjunction with the following drawings in which.

DETAILED DESCRIPTION OF A PREFERRED EMBODIMENT

Figure 1:
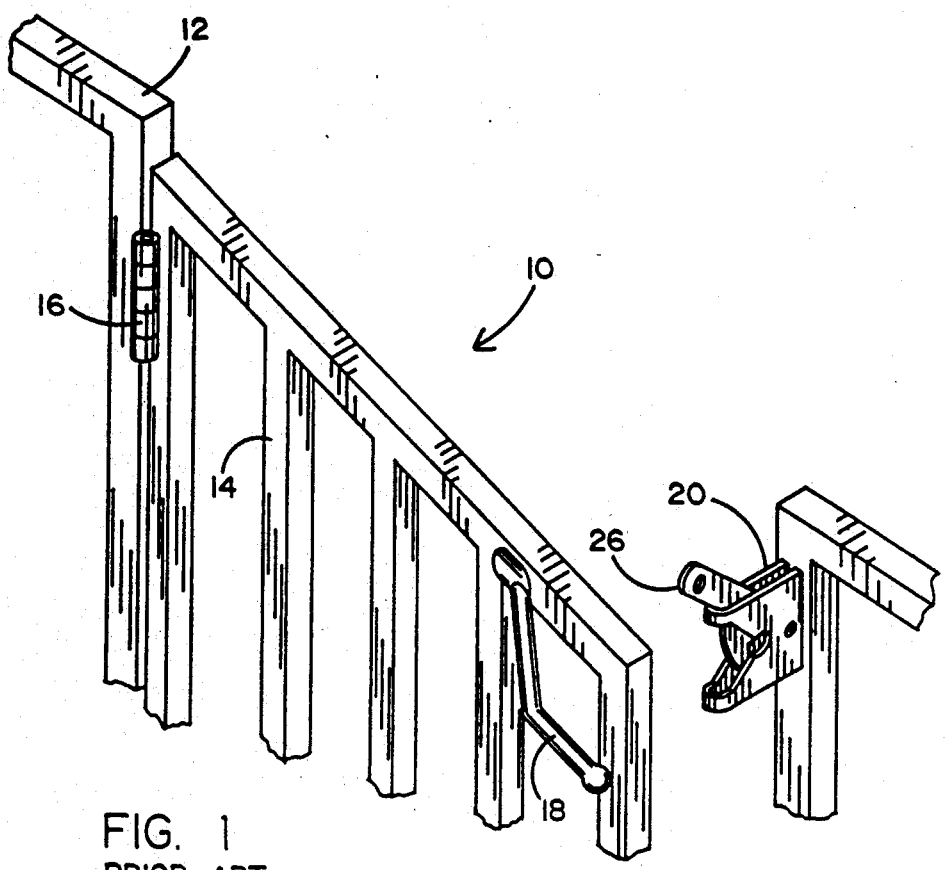
FIG. 1 PRIOR ART
FIGS. 1 and 2 illustrate the open and closed positions, respectively, of a conventional latch gate of the prior art with which the present invention is principally designed for use.
Figure 2:
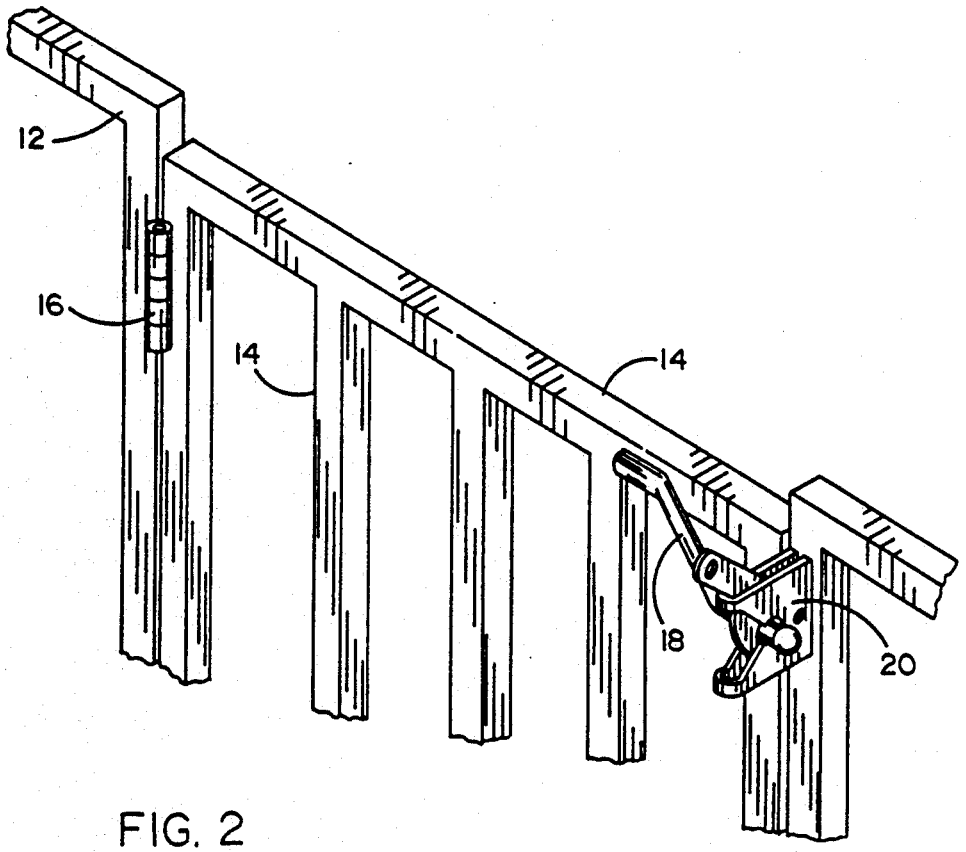
FIG. 2 PRIOR ART
Figure 3:
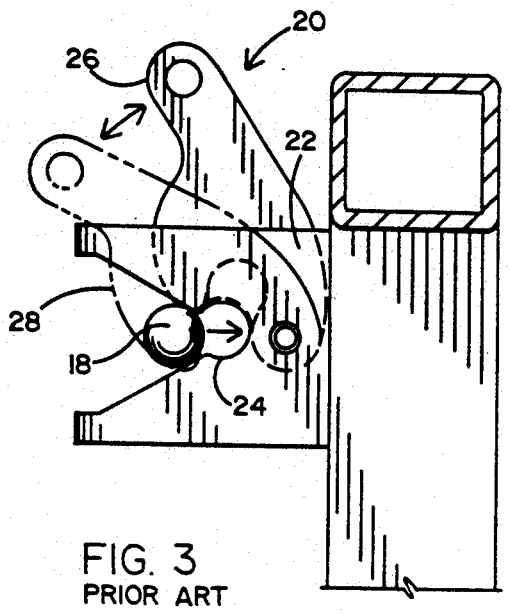
FIG. 3 PRIOR ART
FIG. 3 illustrates a latch assembly of the type normally used with a latch gate of FIGS. 1 and 2 and in particular illustrates a potentially hazardous inadvertent unsecured configuration thereof.

Referring first to FIGS. 1, 2 and 3 of the accompanying drawings, it will be seen that a typical latch gate 10 of the type with which the present invention is designed to function is shown therein. More specifically, it will be seen that the latch gate comprises a frame 12 and a door 14 which is hinged to the frame by means of a spring loaded hinge 16. The door 14 is provided with a latch bar 18 and the frame 12 is provided with a catch 20, the operation of which may be best understood by referring to FIG. 3. As shown in FIG. 3, the catch 20 comprises a catch bracket 22, within which there is provided a bar collar 24. Collar 24 is designed to receive the latch bar 18 when the door 14 is fully closed and in its locked configuration. Locking of the latch bar 18 into the catch 20 is facilitated by a cam retainer 26 which is a hinged element having a cam surface 27 on one side thereof and a locking surface 28 on the other side thereof.

It will be understood that in order to close and lock the latch gate 10 from the opened configuration shown in FIG. 1 to the closed configuration shown in FIG. 2, it is necessary to release the door 14, thereby allowing the spring type hinges 16 to exert a rotational force to the door 14. The latch bar 18 normally strikes the cam surface 27 of cam retainer 26 with sufficient force to rotate the cam retainer from the dotted line configuration of FIG. 3 to the solid line configuration of FIG. 3, thereby permitting the latch bar 18 to pass into the bar collar 24 and be received therein. Once the latch bar is beyond the cam retainer 26, the cam retainer is then free to rotate back into its nominal position, at which point the locking surface 28 engages the latch bar 18 and firmly secures the latch bar within the bar collar 24. Manually unlocking latch gate 10 requires one to rotate the cam retainer 26 from the phantom line configuration shown in FIG. 3 to the solid line configuration shown in FIG. 3, thereby removing the locking surface 28 from the latch bar and allowing the latch bar to be withdrawn from the bar collar 24 upon rotation of the door 14 to facilitate entry through the latch gate 10. In cases where it is desired to prevent young children from entering the latch gate 10, it will of course be understood that the latch bar and catch shown in FIGS. 1 and 2 are mounted at a sufficiently high position to be beyond the reach of young children and thus preclude the inadvertent admission of such young children through the latch gate 10 into a hazardous area such as a swimming pool area.

Unfortunately, the described operation of the latch bar and catch does not always function as intended. This failure may result from a variety of gradual changes. By way of example, wearing of the hinges 16 may ultimately change the relative positions of door 14 and frame 12 sufficiently to reduce the likelihood of latch bar 18 always being securely positioned within bar collar 24. In addition, the spring effect of hinge 16 may be reduced over a period of time, thereby reducing the spring-induced rotational force on door 14, so that without manual assistance, latch bar 18 no longer strikes the cam surface 27 of cam retainer 26 with sufficient force to rotate the cam retainer fully out of the path of latch bar 18. Virtually any change over a period of time which either reduces the force with which door 14 closes relative to frame 12 or slightly misaligns the door and the frame, would tend to at least occasionally preclude reliable locking of the door 14 within the frame 12 as described above. Clearly, whenever latch bar 18 is not fully secured within bar collar 24 with the locking surface 28 of the cam retainer bearing against the bar, the door 14 may then be opened even without access to cam retainer 26 and thus permit a child who cannot reach the cam retainer to still open the door by simply pulling on it. However, it will be seen hereinafter that the present invention comprises a switch assembly preferably attached electrically to an alarm circuit, wherein an alarm will be sounded unless latch bar 18 is firmly secured within bar collar 24.

Figure 4:
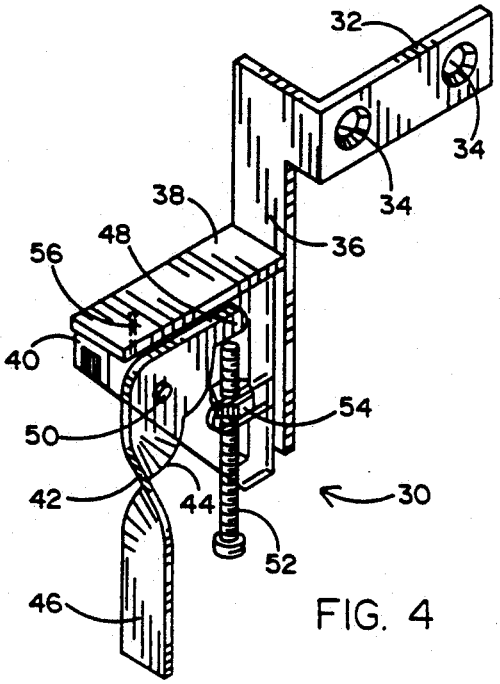
FIG. 4 is a three dimensional drawing of the switch assembly of the present invention.
Figure 5:
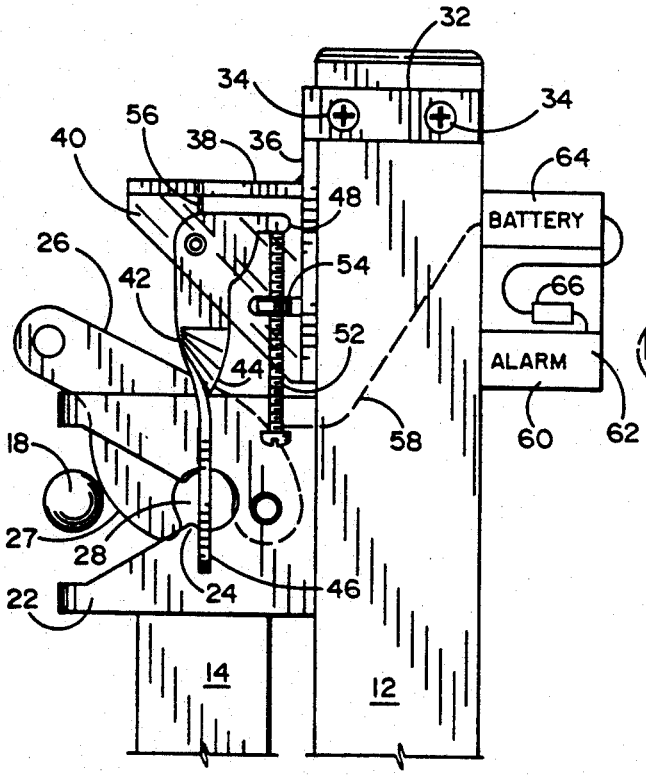
FIG. 5 is an elevational view of the switch assembly of the present invention and an alarm system for use therewith, shown installed on a latch gate in a partially opened position for energizing the alarm system thereof.
Figure 6:
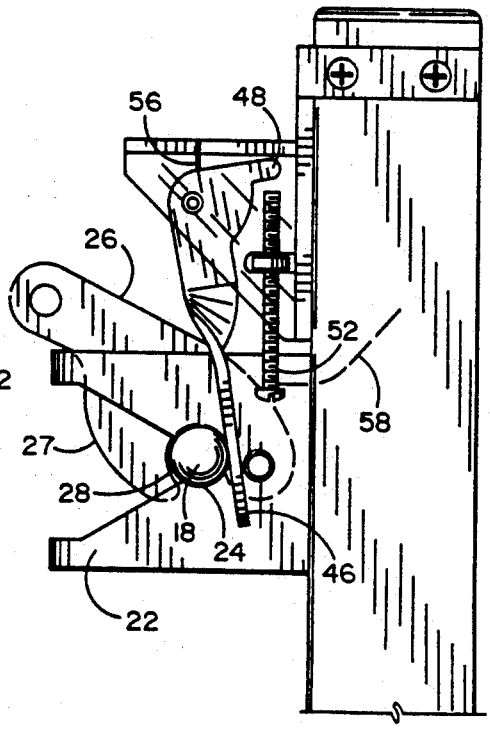
FIG. 6 is an elevational view of the switch assembly of the present invention, similar to that shown in FIG. 5, but illustrating the open circuit configuration of the switch assembly of the invention when the latch gate is in its fully closed and locked configuration.

The switch assembly 30 of the present invention may be understood best by referring to FIGS. 4, 5 and 6. As seen therein, the switch assembly comprises a frame bracket 32 having a pair of screw holes 34 for attachment of the bracket to the latch gate frame 12, immediately above the catch 20. The frame bracket 32 is integrally connected to a vertical member 36, which is in turn, affixed to a horizontal member 38. Bracket 32 and members 36 and 38 are preferably made of a metallic material such as steel or aluminum or the like. Horizontal member 38 and the lower portion of vertical member 36 form a right angle bracket to which there is attached an insulated enclosure 40 which may be made of plastic and is of a generally triangular shape. One triangular side of enclosure 40 is in abutting engagement with the lower surface of horizontal member 38 and one triangular side is in abutting engagement with the lower portion of vertical member 36. The third triangular side of plastic enclosure 40 is open to permit the swinging motion of a switch arm 42 which is mounted within the plastic enclosure 40 for limited angular rotation therein around a shaft 50. The ends of shaft 50 are secured to the walls of the enclosure 40.

Switch arm 42 comprises an upper portion 44 and a lower portion 46. The upper portion is twisted 90 degrees relative to the lower portion so that the upper portion is free to rotate over a limited angle within the plastic enclosure 40, while the lower portion 46 provides a suitable surface for contact by a latch bar 18, as will be more fully understood hereinafter. Switch arm 42 is also provided with a contact 48, the end of which is in juxtaposition with the end of a switch pole such as threaded member 52, which may for example be a headless bolt and which is secured to the plastic enclosure walls by means of a nut 54. The shaft 50, which secures the switch arm 42 for rotation through a limited angle as previously described, may be electrically connected to the horizontal member 38 by means of a jumper wire 56, shown best in FIG. 4. The horizontal member 38 is partially cut away in FIG. 4 to permit unobstructed observation of the jumper wire.

As seen in FIGS. 5 and 6, the switch assembly 30 of the present invention is mounted to the frame 12 of the latch gate 10 so that the lower portion 46 of the switch arm 42 is positioned immediately adjacent the bar collar 24 of the catch 20. Furthermore, it will be seen that when the latch bar 18 is outside the bar collar 24 because the door 14 is opened relative to the frame 12, the lower portion 46 of the switch arm 42 hangs in a relatively vertical position so that contact 48 physically engages the upper end of threaded member 52. It will also be observed that the bottom end of threaded member 52 is connected by means of a wire 58, preferably through the frame 12, but alternatively along the outside edge of frame 12, to a housing 60 on the opposite surface of the frame 12 from the switch assembly 30 Within the housing 60, there are an alarm device 62, a battery 64 and a resistor 66, which together with the switch assembly 30 form the electrical circuit shown schematically in FIG. 7.

Figure 7:
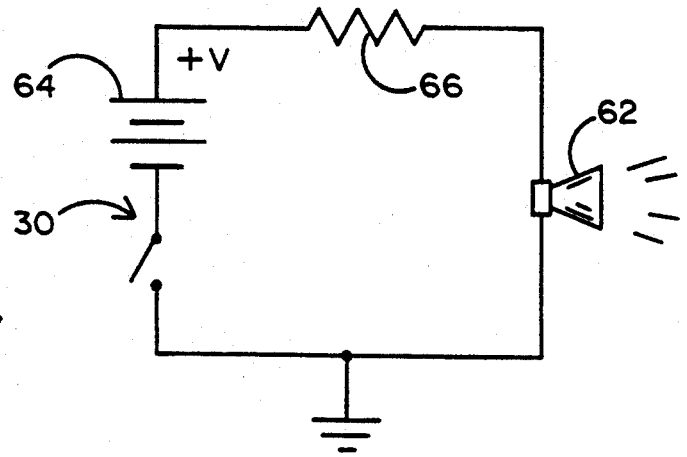
FIG. 7 is a simplified schematic diagram of the electrical circuit of the present invention with the schematic representation of the switch assembly shown in its open position corresponding to the latch gate configuration of FIG. 6.

With the switch assembly 30 in the configuration shown in FIG. 5, that is, with the switch arm positioned by the effect of gravity to allow the contact 48 to engage the upper surface or end of threaded member 52, the circuit of FIG. 7 is in its closed configuration. The alarm 62 is thus activated alerting those in the vicinity of latch gate 10 that the latch gate is not fully locked and secured. However, when the latch gate is in the configuration shown in FIG. 2, namely with the door 14 fully locked and secured relative to frame 12, the latch bar 18 is in the bar collar 24 as shown in FIG. 6. As also shown in FIG. 6, when the latch bar is in its fully secured position, the end of the latch bar engages the lower portion 46 of the switch arm 42, rotating the switch arm around the shaft 50, thereby separating the contact 48 from the upper end of threaded member 52. The switch assembly 30 is thus opened and interrupts the current that would otherwise flow between the battery 64 and the alarm 62.

It will be understood that unless the latch bar 18 is in its fully secured position within the bar collar 24 of the catch bracket 22, switch arm 42 will remain in its vertical position shown in FIG. 5, thereby continuing to energize the alarm 62. Thus, each time the latch gate 10 is opened, an alarm will sound and will remain "ON" and energized until the latch gate is fully locked and secured, requiring manual actuation of the cam retainer 26 in order to unlock the latch gate and open the door 14.

Having thus described a preferred embodiment of the invention which is to be understood as being exemplary only and not to be deemed limiting of the scope of protection afforded hereby, what is claimed is:

1. A switch assembly for use with latch gates of the type having a frame to which a catch is attached and having a door to which a latch bar is attached, the catch having a collar for receiving the bar and a cam retainer for securing the bar when the door is closed; the assembly comprising:

a bracket for securing said assembly to said frame adjacent said catch for interaction with said latch bar;

a switch arm having- an electrical contact and being configured for limited angular movement responsive to the position of said latch bar; and a switch pole positioned for engagement with said electrical contact when said latch bar is not received in said collar and for disengagement from said electrical contact when said latch bar is received in said collar and secured therein by said cam retainer.

2. The switch assembly recited in claim 1 further comprising an insulating enclosure providing an electrically non-conductive structural support for said switch arm and said switch pole.

3. The switch assembly recited in claim 2 wherein said structural support for said switch arm comprises a shaft about which said switch arm moves angularly in response to the position of said latch bar, the axial ends of said shaft being affixed to said insulating enclosure.

4. The switch assembly recited in claim 1 further comprising a battery and an audible alarm device and means for connecting said electrical contact and said switch pole electrically in series with said battery and said alarm device for activating said alarm device whenever said latch bar is not received in said collar.

5. An alarm system for a latch gate of the type having a frame to which a catch is attached and having a door to which a latch bar is attached, the catch having a collar for receiving the bar and a cam retainer for securing the bar when the door is closed; the system comprising:

an electrical power source;

an alarm device; and a switch assembly;

the source, alarm device and switch assembly being electrically interconnected for activation of said alarm device whenever said switch assembly is closed;

said switch assembly having a bracket for securing said assembly to said frame adjacent said catch for interaction with said latch bar;

a switch arm having an electrical contact and being configured for limited angular movement responsive to the position of said latch bar; and a switch pole positioned for engagement with said electrical contact when said latch bar is not received in said collar and for disengagement from said electrical contact when said latch bar is received in said collar and secured therein by said cam retainer.

6. The alarm system recited in claim 5 wherein said switch assembly comprises an insulating enclosure providing an electrically non-conductive structural support for said switch arm and said switch pole.

7. The alarm system recited in claim 6 wherein said structural support for said switch arm comprises a shaft about which said switch arm moves angularly in response to the position of said latch bar, the axial ends of said shaft being affixed to said insulating enclosure.

8. An electrical switch comprising:

a switch pole and a switch arm, the switch arm having a contact for electrically conductive engagement with the switch pole, the switch arm being configured to swing freely through a limited angle about a shaft and being positioned to cause said conductive engagement as a result of only gravitational force acting upon said switch arm, said switch arm being responsive to the application of an additional force to cause rotation of said arm about said shaft to interrupt said electrically conductive engagement and to reestablish said conductive engagement upon removal of said additional force; an electrically insulated enclosure for supporting said arm and said pole; and means for mounting said enclosure on a latch gate of the type having a latch bar, the switch arm being positioned so that said additional force is applied by said latch bar only when said latch gate is securely closed.

* * * * *